US005431112A

United States Patent [19]

Thompson

[11] Patent Number: 5,431,112

[45] Date of Patent: Jul. 11, 1995

[54] SAFETY LOCKING SYSTEM FOR AIR-OPERATED TILT TABLES

[75] Inventor: Ronald J. Thompson, Holland, Mich.

[73] Assignee: International Material Control Systems, Inc., Zeeland, Mich.

[21] Appl. No.: 220,749

[22] Filed: Mar. 31, 1994

[51] Int. Cl.[6] ..... A47F 5/12

[52] U.S. Cl. ..... 108/7; 248/396; 297/284.11; 297/328; 297/DIG. 8; 5/615

[58] Field of Search ..... 108/7, 1, 6; 248/396, 248/394, 397; 297/284.11, 313, 328, DIG. 8; 5/614, 615, 634

[56] References Cited

U.S. PATENT DOCUMENTS

| | | | |
|---|---|---|---|
| 743,344 | 11/1903 | Souder et al. | 108/6 |
| 1,859,456 | 5/1932 | Nestler | 108/2 |
| 3,004,812 | 10/1961 | Miller | 5/614 |
| 3,198,575 | 8/1965 | Hawkins | 297/328 |
| 3,213,809 | 10/1965 | Kritske | 108/2 |
| 3,358,620 | 7/1966 | Parigi | 108/6 |
| 3,599,963 | 8/1971 | Grover | 5/614 |
| 3,638,584 | 2/1972 | Cisler et al. | 108/6 |
| 3,825,244 | 7/1974 | Bauer | 267/124 |
| 3,874,309 | 4/1975 | Cowley | 108/2 |
| 4,180,002 | 12/1979 | Huempfner | 108/6 |
| 4,365,561 | 12/1982 | Tellier et al. | 108/7 |
| 4,462,579 | 7/1984 | Satake | 108/7 |
| 4,605,189 | 8/1986 | Bruncau | 248/162.1 |
| 4,734,945 | 4/1988 | Wright | 5/11 |
| 4,839,932 | 6/1989 | Williamson | 5/615 |
| 5,005,669 | 4/1991 | Umebara et al. | 108/6 |
| 5,014,378 | 5/1991 | Sato | 5/453 |
| 5,131,333 | 7/1992 | Karasawa et al. | 108/7 |
| 5,243,921 | 9/1993 | Kruse et al. | 100/147 |

FOREIGN PATENT DOCUMENTS

| | | | |
|---|---|---|---|
| 75842 | 4/1984 | Japan | 297/284.11 |
| 230833 | 12/1984 | Japan | 297/284.11 |

*Primary Examiner*—Kenneth J. Dorner
*Assistant Examiner*—Janet M. Wilkens
*Attorney, Agent, or Firm*—Waters & Morse

[57] ABSTRACT

A tiltable table has a pneumatic actuator and a locking system for establishing and maintaining a table position. The locking system is operated by an air cylinder that engages a dog with a ratchet plate secured to the table. The dog is spring-biased to locking position, and is air-operated for release against the action of the biasing spring. On lowering the table, air is permitted to escape through a restriction orifice at a slow enough rate to maintain sufficient air pressure to keep the locking system disengaged, but sudden release of all the air pressure will again permit the spring to re-lock the system to prevent a downward slamming of the table surface.

12 Claims, 2 Drawing Sheets

SAFETY LOCKING SYSTEM FOR AIR-OPERATED TILT TABLES

RELATED FIELD

This invention relates to the actuating system for power-operated tilt tables.

BACKGROUND OF THE INVENTION

Many types of equipment involve inclinable table surfaces. Industrial operations often require objects to be tilted or elevated, and hospital equipment must frequently be capable of supporting a patient in an inclined position. Considerable weight may have to be supported in both cases, which has led to power-actuated systems subject to the control of an operator. Air (pneumatic) and liquid (hydraulic) systems for actuating and positioning the moveable table surface are frequently used, depending on the requirements of the particular application. A general term covering both systems would be "fluid"-operated. Compressed air provides quicker action, and less leakage problem, but is compressible. Hydraulic operation is therefore more appropriate where positive positioning by the actuator alone is required. The greater simplicity of the pneumatic system provides an inducement to include some sort of positive positioning for the air-operated actuator. The addition of fail-safe characteristics also increases the number of applications that can utilize the advantage of the pneumatic system. Rupture of an air conduit or air bag actuator is then no longer a hazard.

SUMMARY OF THE INVENTION

The preferred form of the present invention, because of its simplicity, utilizes an accordion-type air bag as an actuator or lifting means. A tiltable member preferable a table panel or a table top is pivotally mounted on a convenient base structure, and the air bag is adapted to apply force between these components. A latch means or locking device, preferably a one-way ratchet latch, selectively locks or fixes the relative position of the base structure and member and prevents the member from falling down on the base structure if the actuator fails. The latch means or locking device comprises an arcuate ratchet plate and detent means. A biasing means urges the detent means to a locking position. The arcuate ratchet plate is preferably mounted on the table panel coaxially with the table pivot. The detent means comprises a ratchet dog is slidably supported in a guideway carried by the base structure in position to move into and out of engagement with the ratchet plate to lock the position of the tiltable panel. Latch actuator means includes latch release means wherein an air cylinder, also mounted on the base structure, has a piston rod connected to the dog to position it. A spring in the cylinder biases the piston to urge the dog to locking position, and an air inlet in the cylinder is located so that air pressure is operable to unlock the dog. This air inlet is in parallel with the exhaust from the air bag, and both are under the control of a selector valve or control valve means. Exhaust from the air bag is directed through a restricted throttling orifice to slow the deflation of the air bag when the selector valve is set to provide an exhaust passage means (corresponding to lowering the table). This provides enough remaining pressure in the air conduit from the air bag to overcome the biasing spring to keep the dog unlocked during the period in which the table is returning to a horizontal position. A blow out in the air bag, or a rupture of air conduit, will so reduce the line pressure as to re-lock the dog to the ratchet plate under the action of the biasing spring. The table will then be prevented from slamming down under the weight it may be carrying.

DESCRIPTION OF THE PREFERRED EMBODIMENTS

Figure 1:
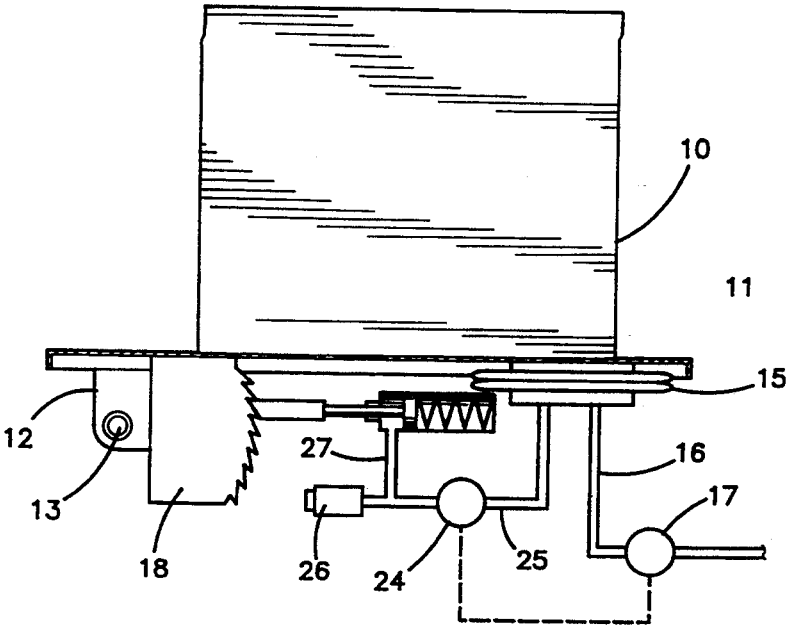
FIG. 1 is a schematic view showing the condition of the system prior to the actuation which would induce tilting.
Figure 2:
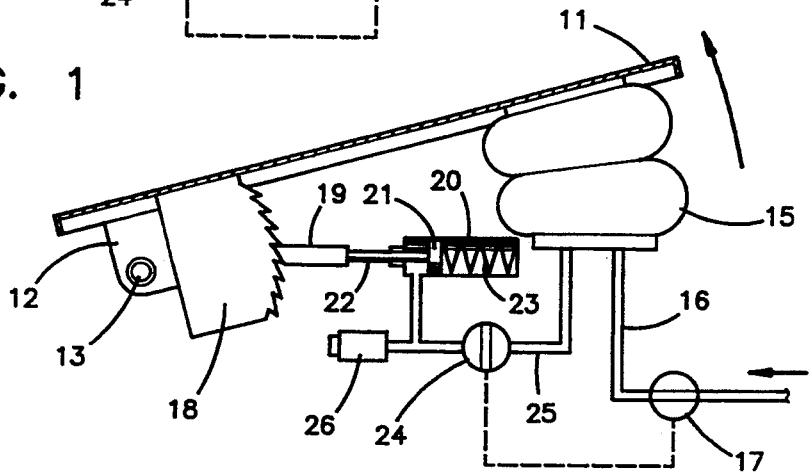
FIG. 2 is a schematic view of the same components that appear in FIG. 1, but in the position corresponding to movement of the table surface to an inclined position.

Referring to FIGS. 1–4, an object of any description is indicated at 10, representing a weight carried by the tiltable table surface 11. This table panel includes an arm 12 extending to a pivotal connection 13 providing a fulcrum on the base structure 14 shown in FIG. 5. An accordion-type air bag 15 is mounted on the base structure, and acts against the underside of the table panel 11 when it is necessary to move it to an inclined position. Compressed air is admitted to the air bag through the conduit 16 under the control of the valve 17.

A ratchet plate 18 is secured to the table panel 11, with the arcuate notched periphery concentric with the axis of the pivot 13. The inclination of the notches of the ratchet plate is selected to provide a positive lock against a return of the table surface to the horizontal position when the dog 19 is in the locking position shown in FIG. 2. A cylinder 20, also mounted on the base structure, carries a piston 21 with a piston rod 22 extending to a connection with the dog 19. The compression spring 23 biases the dog 19 into the locking position shown in FIG. 2, in the absence of significant air pressure in the cylinder in the portion to the left of the piston 21 shown in FIG. 2. As the valve 17 is set to admit air through the conduit 16 to inflate the air bag 15, the upward tilting movement of the table is accompanied by a cam action (due to the incline of the teeth of the ratchet) that moves the dog 19 to the right against the action of the spring 23. This action continues during the selected degree of extension of the air bag 15.

Figure 3:
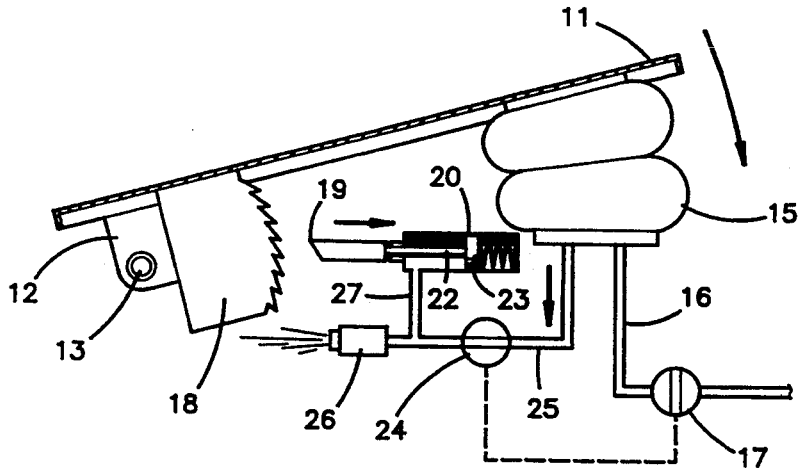
FIG. 3 is a view of the same components as appear in FIGS. 1 and 2, showing the condition of the components corresponding to a gradual lowering of the table.
Figure 4:
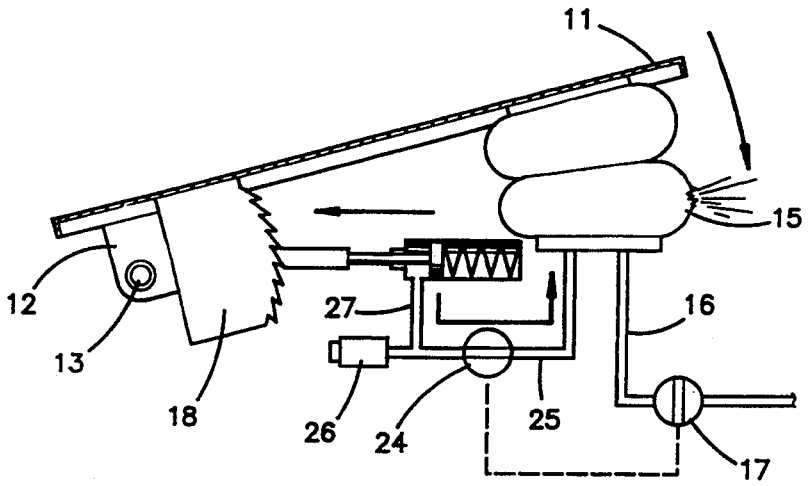
FIG. 4 is a view of the same components as appearing in FIGS. 1–3, but in the position corresponding to a rupture of an air line or the air bag actuator.

When it becomes necessary to lower the table back toward the horizontal position, the valve 17 is first checked to be sure that it is in closed position. It may well have been placed there previously, on establishment of a desired degree of tilt to the table panel. The valve 24 is then opened, permitting air to flow out through the conduit 25 from the air bag 15, and be discharged through the restricted orifice unit 26. The effect of this restricted discharge is to maintain sufficient pressure in the left end of the cylinder 20 to overcome the biasing action of the spring 23, and permit the dog 19 to withdraw from the ratchet plate 18. The exhaust pressure conditions in the air bag 15 are maintained within the cylinder 20 through the connection 27, which has the effect of placing the left side of the cylinder in parallel with the conditions in the air bag. This condition is illustrated in FIG. 3, corresponding to the gradual lowering of the table panel 11 toward a horizontal position. If the air bag 15 or the pressure conduits rupture, however, a fail-safe condition immediately sets in. Pressure in the air line 27 is suddenly reduced to the point that the action of the spring 23 instantly moves the dog 19 into the locking position shown in FIG. 4. The system will remain in this condition until the air pressure conditions are reestablished. The result of this arrangement is to prevent the table panel 11 from slamming down under the effect of the weight 10, and causing damage or injury. For convenience, the valves 17 at 24 may be combined into a single unit that can be placed in positions corresponding to the illustrated conditions.

Figure 6:
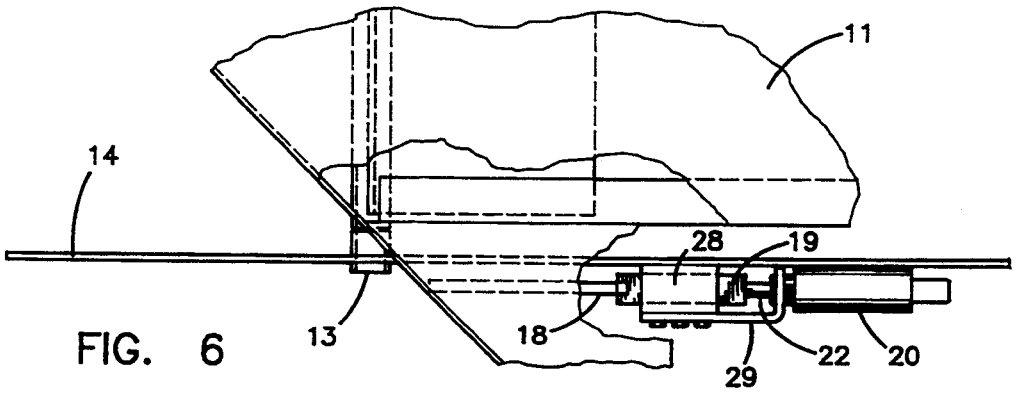
FIG. 6 is a top view of the mechanism appearing in FIG. 5.
Figure 5:
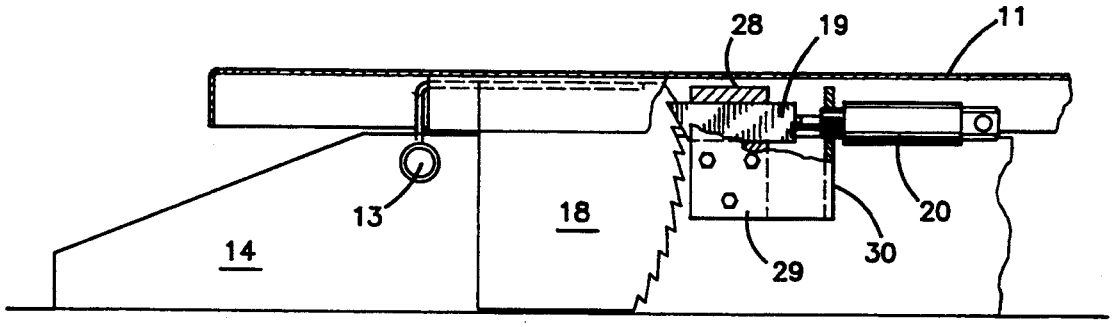
FIG. 5 is a side elevation of the locking mechanism shown in the locked position.

Referring to FIGS. 5 & 6, the dog 19 is slidably supported in a guideway structure 28 carried by the bracket 29 mounted on the base 14. The bracket also has a flange 30 on which the cylinder 20 is mounted. The mounting of this locking system will vary in detail with the particular base structure on which the tilting table is supported. It should be noted that a natural biasing system is continually present urging the table panel to a horizontal position in opposition to the actuating system. This is due to the effect of the weight on the table panel, and the weight of the panel itself. These forces will normally be eccentric to the pivotal mounting of the table.

I claim:

1. In combination with a base structure and a member movably mounted on said base structure, a fail-safe actuating system including a fluid-pressure actuator and a locking device operable to fix the relative position of said base structure and member wherein the improvement comprises:

a pneumatic piston-cylinder unit mounted on one of said base structure and member;

detent means constituting part of said locking device, and operable by said piston-cylinder unit to unlock said locking device in response to pressure within said actuator; and biasing means urging said detent means to locking position.

2. A system as defined in claim 1 wherein said locking device includes a ratchet plate mounted on the other of said base structure and said member, said detent means and ratchet plate having a configuration providing freedom of movement of said member in a selected direction on extension of said actuator.

3. A system as defined in claim 1, wherein said member is a table panel pivotally mounted on said base structure, and said actuator is operable to incline said table panel from a horizontal position.

4. A system as defined in claim 3, wherein said locking device includes an arcuate toothed ratchet plate mounted on said table panel, and said piston-cylinder unit is mounted on said base structure, said arcuate ratchet plate and pivotal mounting being coaxial.

5. A system as defined in claim 1, further including control valve means whereby fluid pressure may be selectively admitted to said actuator and released therefrom.

6. In combination with a base structure and a member movably mounted on said base structure, a fail-safe actuating system including a fluid-pressure actuator and a locking device operable to fix the relative position of said base structure and member wherein the improvement comprises:

a piston-cylinder unit mounted on one of said base structure and member;

detent means constituting part of said locking device, and operable by said piston-cylinder unit to unlock said locking device in response to pressure within said actuator;

biasing means urging said detent means to locking position;

control valve means whereby fluid pressure may be selectively admitted to said actuator and released therefrom; and exhaust passage means having a throttling orifice adapted to restrict outflow from said actuator to maintain sufficient pressure in said piston-cylinder unit to overcome said biasing means and disengage said detent means.

7. A system as defined in claim 6, wherein said actuator is an extendable air bag having opposite ends thereof secured to said base structure and said table panel, respectively.

8. A system as defined in claim 6, wherein said actuating system includes biasing means urging said member to a horizontal position.

9. A safety locking system for a fluid operated tilt table wherein the tilt table comprises a tilting table top pivotally mounted on a base for movement between a horizontal position and an upwardly inclined position, the tilt table further comprising a fluid operated lift means for lifting and lowering the table top with respect to the base, the lift means being such that there is an elevated internal fluid pressure in the lift means when the table top is supported in an elevated position above the base by the lift means, the safety locking system comprising:

a releasable mechanical latch means for preventing the table top from lowering from a raised position toward the base when the latch means is engaged, the table top being lowerable when the latch means is released;

latch actuator means for engaging and releasing the latch means, the latch actuator means including:

resilient biasing means for urging the latch means toward its engaged position; and fluid operated latch release means for urging the latch means toward its released position, the latch release means causing the latch means to become released when the latch release means is pressurized with sufficient fluid pressure to overcome the resilient biasing means, the latch release means being in fluid communication with the lift means such that the fluid pressure in the latch release means is representative of the fluid pressure in the lift means, the pressure in the latch release means being sufficient to release the latch means when the lift means is operating normally to lower the table top but being insufficient to prevent the resilient biasing means from automatically moving the latch means to its engaged position if pressure is suddenly lost from the lift means, the latch means holding the table top in its elevated position and preventing the table top from falling down if fluid pressure is lost in the lift means.

10. A safety locking system according to claim 9 wherein the lift means includes control means for gradually releasing fluid pressure from an outlet in the lift means to gradually lower the table top, the latch release means being in fluid communication with the lift means at a point in the lift means where the latch release means holds the latch means in its released position while the table top is being lowered normally by the control means, the latch means becoming engaged if pressure in the lift means is reduced to a level indicative of a failure of fluid pressure in the lift means.

11. A safety locking system according to claim 10 wherein the lift means comprises an inflatable air bag and the fluid is air, the control means comprising a control valve that opens and closes the lift means outlet and a flow restricting device connected to the lift means outlet that causes the air to be released gradually when the control valve is open, such that the table top lowers slowly when the control valve is open, the latch release means comprising an air cylinder that is resiliently biased to engage the latch means but releases the latch means when pressurized, the air cylinder being connected to the lift means at a point upstream of the flow restricting device, such that sufficient air pressure is present in the air cylinder to hold the latch means in a released position while the table top is lowering normally.

12. A safety locking system according to claim 11 wherein the latch means is a one-way ratchet latch that allows the table to be raised but not lowered while the latch is engaged, the control valve being positioned upstream of the flow restricting device and the air cylinder being connected in communication with the lift device outlet at a position between the flow restricting device and the control valve, such that the air cylinder is pressurized to release the latch means only where the control valve is opened to lower the table top.

* * * * *